US007436245B2

(12) United States Patent
Nguyen

(10) Patent No.: US 7,436,245 B2
(45) Date of Patent: Oct. 14, 2008

(54) VARIABLE SUB-BANDGAP REFERENCE VOLTAGE GENERATOR

(75) Inventor: Nam Duc Nguyen, San Jose, CA (US)

(73) Assignee: Exar Corporation, Fremont, CA (US)

( * ) Notice: Subject to any disclaimer, the term of this patent is extended or adjusted under 35 U.S.C. 154(b) by 58 days.

(21) Appl. No.: 11/430,508

(22) Filed: May 8, 2006

(65) Prior Publication Data

US 2007/0257655 A1 Nov. 8, 2007

(51) Int. Cl.
*G05F 3/16* (2006.01)

(52) U.S. Cl. ..... 327/539; 323/316; 323/315; 327/540

(58) Field of Classification Search ..... 323/313, 323/314, 316, 907, 315; 327/539, 540
See application file for complete search history.

(56) References Cited

U.S. PATENT DOCUMENTS 4,250,445 A 2/1981 Brokaw
5,666,046 A * 9/1997 Mietus ..... 323/313
6,052,020 A 4/2000 Doyle
6,150,872 A * 11/2000 McNeill et al. ..... 327/539
6,323,630 B1 * 11/2001 Banba ..... 323/313
6,529,066 B1 * 3/2003 Guenot et al. ..... 327/539
6,958,597 B1 * 10/2005 Lin et al. ..... 323/313
6,972,550 B2 12/2005 Hong
7,119,528 B1 * 10/2006 Rasmus ..... 323/317
7,164,260 B2 * 1/2007 Neaves ..... 323/316
2004/0036460 A1 * 2/2004 Chatal ..... 323/313

* cited by examiner

*Primary Examiner*—Shawn Riley
(74) *Attorney, Agent, or Firm*—Townsend and Townsend and Crew LLP

(57) ABSTRACT

A sub-bandgap reference voltage generator, generates a pair of variable voltages one having a positive temperature coefficient and one having a negative voltage coefficient. The pair of voltages are added to generate an output voltage whose value and temperature may be varied. To achieve this, a first voltage having a positive temperature coefficient is multiplied by a first ratio defined by first and second resistive values to generate a second voltage. A third voltage having a negative temperature coefficient is multiplied by a second ratio defined by third and fourth resistive values to generate a fourth voltage. The second and fourth voltages are added together to generate the output voltage of the sub-bandgap voltage generator.

14 Claims, 4 Drawing Sheets

VARIABLE SUB-BANDGAP REFERENCE VOLTAGE GENERATOR

CROSS-REFERENCES TO RELATED APPLICATIONS

Not Applicable

STATEMENT AS TO RIGHTS TO INVENTIONS MADE UNDER FEDERALLY SPONSORED RESEARCH OR DEVELOPMENT

Not Applicable

REFERENCE TO A "SEQUENCE LISTING," A TABLE, OR A COMPUTER PROGRAM LISTING APPENDIX SUBMITTED ON A COMPACT DISK

Not Applicable

BACKGROUND OF THE INVENTION

The present invention relates to integrated circuits, and more particularly, to a programmable integrated bandgap operative at relatively low voltages.

Bandgap reference voltage generators (alternatively referred to as bandgap reference circuits) are used in a wide variety of electronic circuits, such as wireless communications devices, memory devices, voltage regulators, etc. A bandgap reference circuit often supplies an output voltage that is relatively immune to changes in input voltage or temperature.

A bandgap reference circuit is typically adapted to use the temperature coefficients associated with physical properties of the semiconductor devices disposed therein to generate a nearly temperature-independent reference voltage. A bandgap reference circuit operates on the principle of compensating the negative temperature coefficient of $V_{BE}$—which is the base-emitter voltage of a bipolar transistor—with the positive temperature coefficient of the thermal voltage $V_T$. In its most basic form, the $V_{BE}$ voltage is added to a scaled $V_T$ voltage using a temperature-independent scale factor K to supply the reference voltage $V_{ref}$, as shown below:

$$V_{ref}=V_{BE}+K*V_T \quad (1)$$

Because voltage signals $V_{BE}$ and $V_T$ exhibit opposite-polarity temperature drifts, parameter K may be selected such that voltage $V_{ref}$ is nearly independent. As is known to those skilled in the art, thermal voltage $V_T$ is equal to kT/q, where, where k is Boltzmann's constant, T is the absolute temperature in degrees Kelvin, and q is the electron charge.

In addition to being temperature independent, a bandgap reference circuit is ideally also adapted to supply a substantially stable and unchanging output reference voltage despite variations in the input voltage levels received by or the capacitive loading applied to the bandgap circuit. Accordingly, an ideal bandgap reference circuit output is also immune to ripples or noise that is typically present in the power source supplying voltage to the bandgap reference circuit. However, most bandgap reference circuits exhibit non-ideal characteristics. One measure of the ability of a bandgap reference circuit to suppress or reject such supply ripple or noise voltages is referred to as the power supply ripple rejection (PSRR).

The growth in demand for battery-operated portable electronic devices, such as wireless communications devices and personal digital assistance devices, has brought to the fore the need to develop low voltage, low power systems. For instance, many portable wireless systems are being designed to operate using batteries that supply, for example, 1.2 volts. Designing a bandgap reference circuit adapted to operate at such low voltages poses a challenging task.

There continues to be a need for a bandgap reference circuit that is operable at low voltages and is further adaptable to achieve different output voltages having nearly zero temperature coefficients.

BRIEF SUMMARY OF THE INVENTION

A variable sub-bandgap reference voltage generator, in accordance with one embodiment of the present invention, generates a pair of variable voltages one having a positive temperature coefficient and one having a negative voltage coefficient. The pair of voltages is added to generate an output voltage whose value and temperature may thus be varied.

In some embodiments, the variable sub-bandgap reference voltage generator includes, in part, a first diode receiving a first current source and supplying a first voltage at its positive terminal; a second diode receiving the second current source and supplying a second voltage at its positive terminal. The first diode has an area N times the area of the second diode. Such embodiments also include, in part, a first voltage adder/subtractor adapted to subtract the first voltage from the second voltage to generate a third voltage, a first amplifier having a voltage gain of greater than one and configured to amplify the third voltage to generate a fourth voltage; a second voltage amplifier having a voltage gain of smaller than one and configured to amplify the first voltage to generate a fifth voltage; and a second voltage adder/subtractor adapted to add the third voltage to the fourth voltage. The second voltage amplifier may be configured to amplify the second voltage to generate a fifth voltage instead of amplifying the first voltage.

DETAILED DESCRIPTION OF THE INVENTION

A variable sub-bandgap reference voltage generator, in accordance with one embodiment of the present invention, includes, in part, first and second amplifiers and first and second voltage adder/subtractor. A first current generates a voltage at a first node that is separated from the ground potential via a first diode. A second current generates a voltage at a second node that is separated from the ground potential via a second diode. The first and second currents may be equal. The first voltage adder subtracts the voltage generated across the first node to or from the voltage generated at the second node to generate a third voltage. The voltage at the first or second node is amplified with the second amplifier having a gain of less than one to generate a fifth voltage. The first amplifier has a gain of greater than one and amplifies the third voltage to generate a fourth voltage. The second voltage adder adds the fourth and fifth voltages to generate the sub-bandgap reference voltage.

Figure 1:
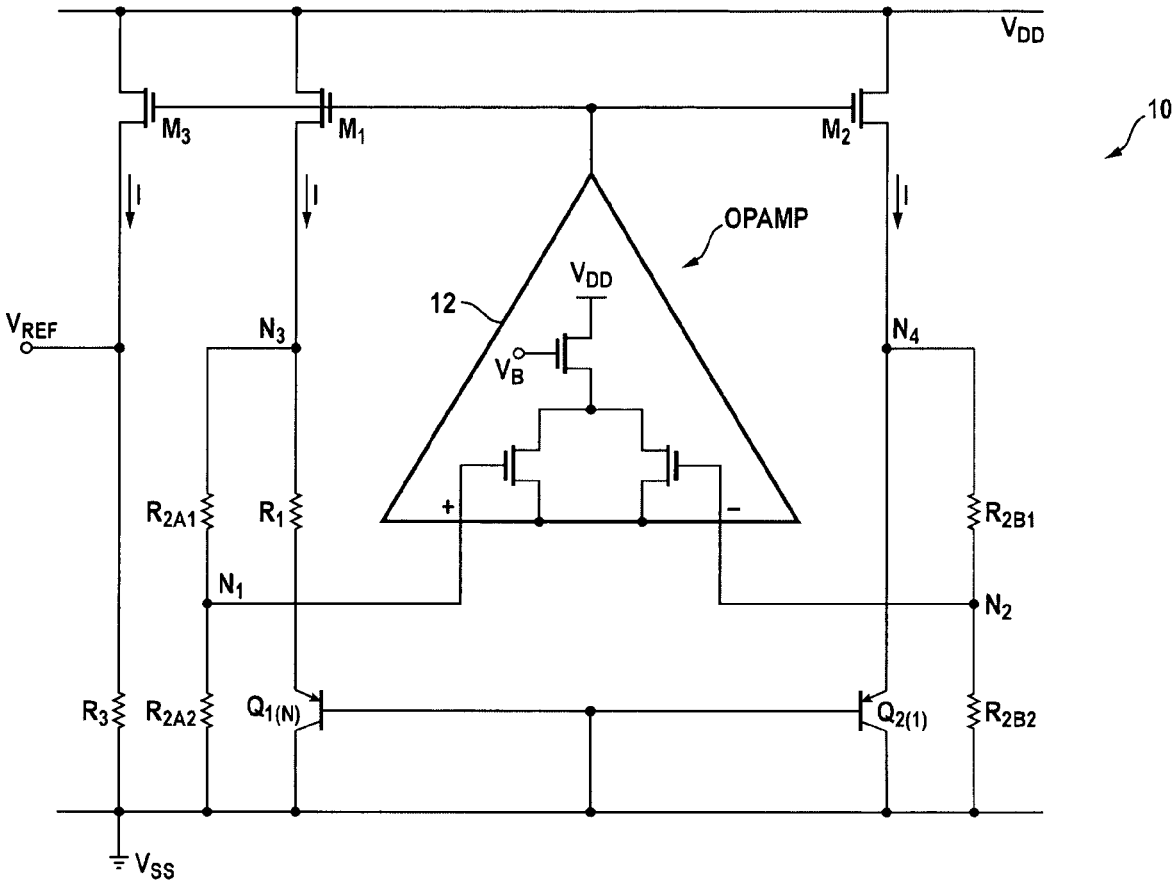
FIG. 1 (PRIOR ART)
FIG. 1 is a transistor schematic diagram of a low-voltage bandgap reference circuit, as known in the prior art.
Figure 2:
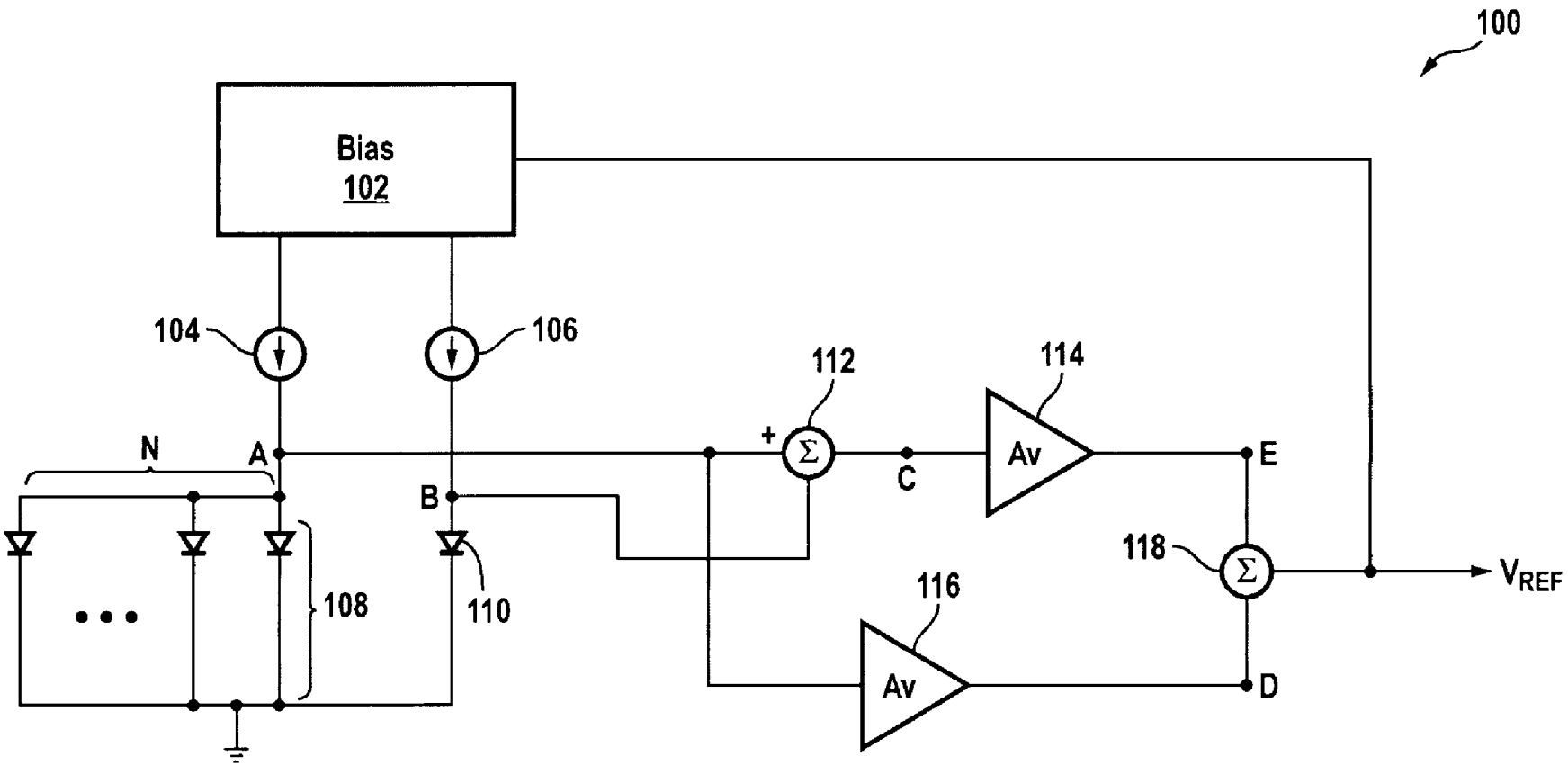
FIG. 2 is a block diagram of a sub-bandgap reference circuit, in accordance with one embodiment of the present invention.

FIG. 2 is a block diagram of a bandgap reference circuit 100 adapted to operate at voltages of 1.2 volt or less, in accordance with one embodiment of the present invention. The exemplary embodiment of bandgap reference circuit 100 is shown as including bias circuit 102, operational amplifiers 114, 116, voltage adders/subtractors 112, 118, and diodes 108, 110. Diode 108 has an area that is N times the area of diode 110. Alternatively diode 108 may include N diodes each having an area similar to the area of diode 110. In the following voltage adder/subtractor blocks 112, 116 are also alternatively referred to as adders. It is understood, however, that an adder may be used to perform subtraction.

Bias circuit 102 generates a pair of currents 104 and 106 that flow through diodes 108, 110. Current 104 causes a voltage to develop across node A. Similarly, current 106 causes a voltage to develop across node B. Voltage adder 112 subtracts the voltage at node A from the voltage at node B and supplies the subtracted voltage value to node C. Amplifier 116, which has a voltage amplification of less than 1, receives the voltage at node A or B and generates an output voltage to node D. Amplifier 114, which has a voltage amplification of greater than 1, receives the voltage at node C and generates an output voltage to node E. Voltage adder 118 adds the voltages at nodes D and E and supplied the added voltage as the output voltage Vref.

Figure 3:
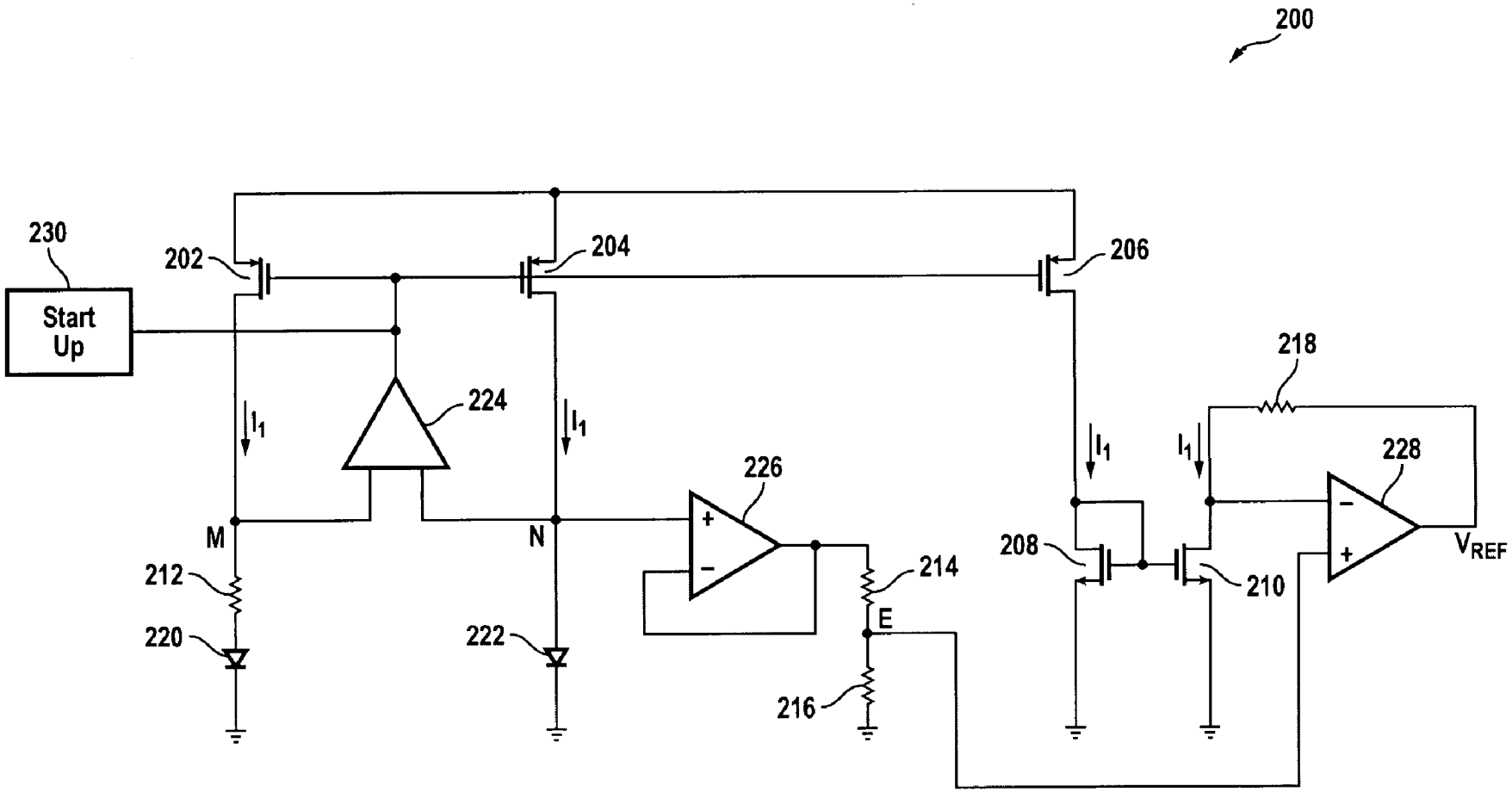
FIG. 3 is a transistor diagram of a sub-bandgap reference circuit, in accordance with another embodiment of the present invention.

FIG. 3 is a transistor schematic diagram of a variable sub-bandgap reference circuit 200 adapted to operate at voltages of 1.2 volt or less, in accordance with another embodiment of the present invention. A variable sub-bandgap reference circuit 200 is shown as including transistors 202, 204, 206, 208, 210, resistors 212, 214, 216, 218, diodes 220, 222, amplifiers 224, 226, 228, and start-up circuitry 230. Start-up circuit 230 properly biases sub-bandgap reference circuit 200 during the start-up phase. Transistors 206, 202 and 204 have the same gate-to-source voltage, therefore substantially the same currents I flows through transistors 206, 202 and 204. In other words, transistors 206, 202 and 204 form a triple current mirror. Current I generated by transistor 202 flows through resistor 212 and diode 220. Current I generated by transistor 204 flows through diode 222.

Amplifier 226 in combination of resistors 214, 216 form one embodiment of a circuit corresponding to amplifier 116 shown in FIG. 2. Resistors 218, 212 together with the current mirror that has transistors 208, 162 disposed therein, and amplifier 228 form one embodiment of a circuit corresponding to amplifier 114 and voltage adders 112, and a voltage summer 118. Diode 220 has an area that is N times the area of diode 222. Alternatively diode 220 may include N parallel diodes with a collectively area of N times the area of diode 222. Current $I_1$ is mirrored through Transistors 208 and transistor 210. The two current mirrors (202, 204, and 206) and (208 and 210) may be cascode current mirrors.

Because the gate-to-source voltage of PMOS transistors 202 and 204 is the same, the same current $I_1$ flows through both PMOS transistors 202 and 204. As is known to those skilled in the art, the voltages at input terminals M and N of Operational amplifier (hereinafter alternatively referred to as op amp) 224 are substantially the same. Therefore, because the voltage at node N is one $V_{BE}$ above the ground potential, the voltage at node M is also one $V_{BE}$ above the ground potential. Diode 220 is so adapted as to have an area that is N times the area of emitter 222. Accordingly, because the area of diode 220 is N times the area of diode 22 and because the same current flows through transistors 202 and 204, and further, because nodes M and N have substantially the same voltage, current $I_1$ that flows through each of transistors 202 and 204 is defined by the following equation:

$$I_1 = V_T * InN / R_{122} \tag{2}$$

where $R_{212}$ is the resistance of resistor 212. Since the same current $I_1$ flows through resistors 218 and 212, the voltage across resistor 218 is an amplified replica of the voltage across resistor 212. Accordingly, voltage Vref appearing at the output terminal of amplifier 222 is, in part, defined by the following expression:

$$\frac{R_{218}}{R_{212}} \times V_{R_{212}} + V_E \tag{3}$$

where $$V_E = (V_{BE} \times R_{216}) / (R_{214} + R_{216}) \tag{4}$$

Wherein $V_{BE}$ is the base-emitter voltage, i.e., the $V_{BE}$, of a bipolar transistor formed by two diodes 220 and 222 with their bases connected to their collectors respectively. The temperature coefficients of base-to-emitter voltage $V_{BE}$ and thermal voltage $V_T$ are also known. For example, voltage $V_{BE}$ typically has a temperature coefficient of −2 mv/C.° and voltage VT is equal to KT/q.

Voltage Vref is the sum of the voltages defined by expressions (3) and (4) and as shown below:

$$Vref = \frac{R_{218}}{R_{212}} \times V_T + \frac{R_{216}}{R_{214} + R_{216}} \times V_{BE} \tag{5}$$

The ratio of resistors R218 and R212 may be replaced by the ratios of any two current mirror ratios.

As seen from the above, bandgap reference circuit 200, in accordance with the present invention, generates and sums two independent voltages. The first voltage component defined by expression (3) has a positive temperature coefficient. The voltage component defined by expression (4) has a negative temperature coefficient. Furthermore, the value of voltage Vref may be varied by changing the values of resistors 212, 218, 214, and 216.

Figure 4:
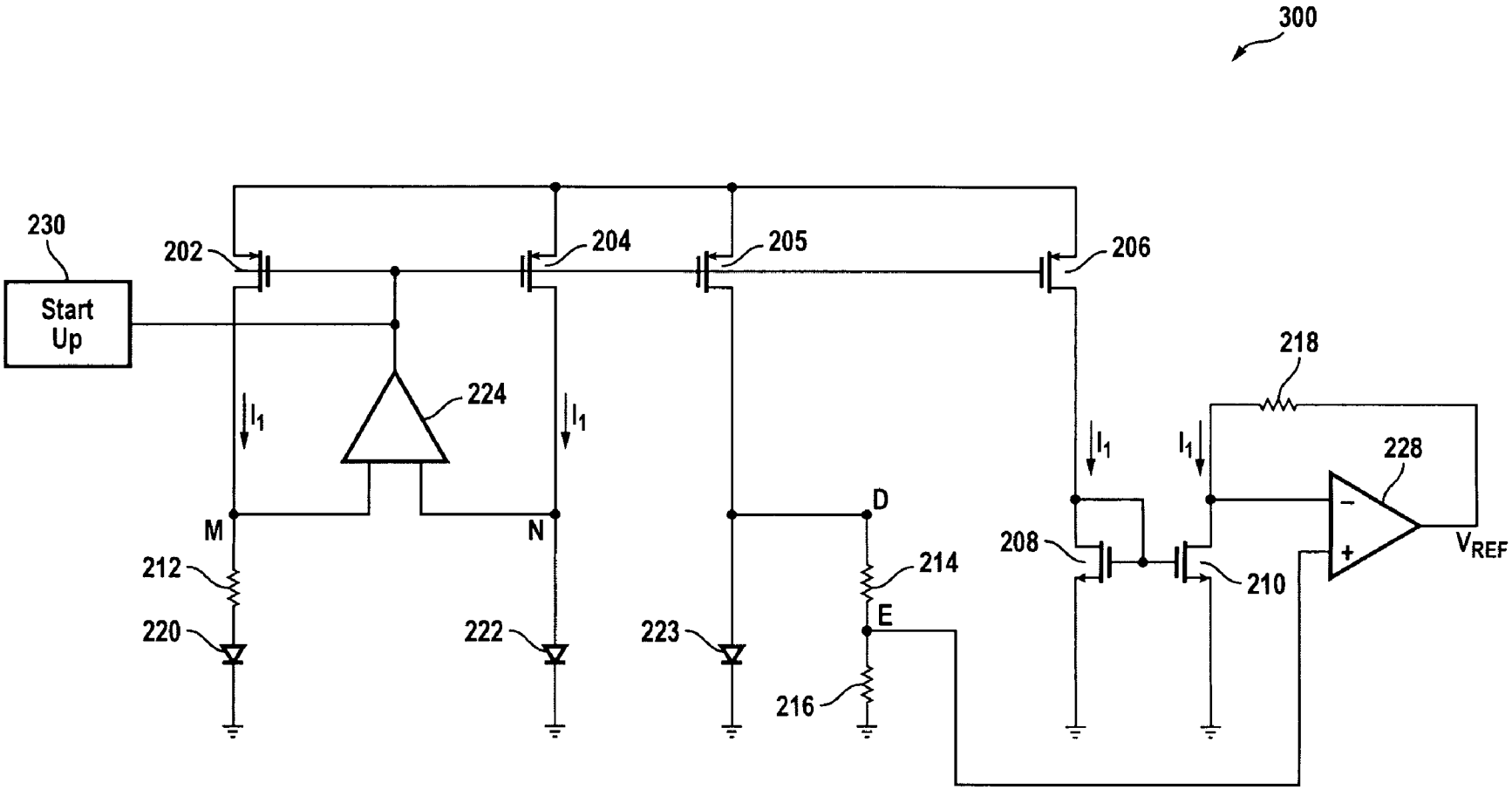
FIG. 4 is a transistor diagram of a sub-bandgap reference circuit, in accordance with another embodiment of the present invention.

FIG. 4 is a transistor schematic diagram of a variable sub-bandgap reference circuit 300 adapted to operate at voltages of 1.2 volt or less, in accordance with yet another embodiment of the present invention. Embodiment 300 of variable sub-bandgap reference circuit 300 is similar to embodiment 200 except that embodiment 300 includes PMOS transistor 205 in place of amplifier 206 of embodiment 200 and a diode 223 whose positive terminal is connected to one terminal of resistor 214 (node D) and its negative terminal is connected to ground. The width of PMOS transistor 205 is greater than the width of PMOS transistor 204.

The above embodiment of the present invention re illustrative and not limitative. The invention is not limited by the type of the operational amplifier, transistor, resistor, etc, disposed in the bandgap reference circuit. The invention is not limited by number of closed-loop circuits that generate currents with either positive or negative temperature coefficients. Nor is the invention limited by the number of output stages each of which may generate an output voltage having a temperature coefficient different from those of the others. Other additions, subtractions or modification are obvious in view of the present invention and are intended to fall within the scope of the appended claims.

What is claimed is:

1. An Integrated Circuit comprising:

a first diode receiving a first current at its positive terminal and configured to supply a first voltage at its positive terminal;

a second diode receiving the second current at its positive terminal and configured to supply a second voltage at its positive terminal; wherein said first diode has an area N times the area of the second diode, a first voltage adder/subtractor adapted to subtract the first voltage from the second voltage to generate a third voltage in response;

a first voltage gain stage having a voltage gain of greater than one and configured to amplify the third voltage to generate a fourth voltage in response;

a second voltage gain stage having a voltage gain of smaller than one and configured to amplify the first or second voltage to generate a fifth voltage in response;

a second voltage adder/subtractor adapted to add the fifth voltage to the fourth voltage.

2. The Integrated Circuit of claim 1 wherein each of the first and second voltage gain stages is an operational amplifier.

3. A method comprising:

subtracting a second voltage from a first voltage to generate a third voltage;

multiplying the third voltage by a factor greater than one to generate a fourth voltage;

multiplying the first voltage by a factor smaller than one to generate a fifth voltage; and adding the fourth and fifth voltages to generate a sixth voltage.

4. The method of claim 3 wherein each of the third and fourth voltages has a positive temperature coefficient, and wherein the fifth voltage has a negative temperature coefficient.

5. The method of claim 4 wherein the sixth voltage has a temperature coefficient that is nearly zero.

6. An Integrated Circuit comprising:

a first amplifier having a first input terminal coupled to a first node and a second input terminal coupled to a second node; wherein each of the first and second nodes is adapted to receive a first current level;

a second amplifier having a first input terminal coupled to the second node and a second input terminal coupled to an output terminal of the second amplifier;

a current mirror adapted to supply a current substantially equal to the first current level;

a third amplifier having a first input terminal coupled to a third node disposed in the current mirror and a second input terminal adapted to receive a divided down voltage of an output voltage generated by the second output amplifier; and a first resistive load coupled between the first input terminal and an output terminal of the third amplifier.

7. The Integrated Circuit of claim 6 further comprising:

a second resistive load having a first terminal coupled to the first node;

a first diode junction having a first region coupled to the second terminal of the second resistor; and a second diode junction having a first region coupled to the second.

8. The Integrated Circuit of claim 7 wherein each of said first and second junction diodes has a second region coupled to the ground potential.

9. The Integrated Circuit of claim 8 wherein said second amplifier has a voltage gain that is smaller than one.

10. The Integrated Circuit of claim 9 further comprising:

a first transistor having a gate terminal coupled to an output terminal of the first amplifier and a drain terminal coupled to the first node; and a second transistor having a gate terminal coupled to the output terminal of the first amplifier and a drain terminal coupled to the second node.

11. The Integrated Circuit of claim 10 wherein said current mirror comprises:

a third transistor having a gate terminal coupled to the gate terminals of the first and second transistors;

a fourth transistor having gate and drain terminals coupled to a drain terminal of the third transistor; and a fifth transistor having a gate terminal coupled to the gate terminal of the fourth transistor and a drain terminal coupled to the third node.

12. A method of generating a voltage, the method comprising:

generating a first voltage having a positive temperature coefficient;

multiplying the first voltage by a first ratio defined by first and second resistive values to generate a second value;

generating a third voltage having a negative temperature coefficient;

multiplying the third voltage by a second ratio defined by third and fourth resistive values to generate a fourth voltage; and combining the second and fourth voltages.

13. The method of claim 12 wherein said first voltage is generated by a first circuit comprising a first amplifier, a second amplifier, and a resistive voltage divider, wherein the first amplifier has a first input terminal coupled to a first node and a second input terminal coupled to a second node; wherein each of the first and second nodes is adapted to receive a first current level; and wherein the second amplifier has a first input terminal coupled to the second node and a second input terminal coupled to an output terminal of the second amplifier; wherein said resistive voltage divider is disposed between an output terminal of the second amplifier and a negative voltage supply.

14. The method of claim 13 wherein said second voltage is generated by a second circuit comprising a current mirror, a third amplifier, and a first resistive load, wherein said third amplifier comprises a first input terminal coupled to a third node disposed in the current mirror and a second input terminal adapted to receive a voltage supplied by the resistive voltage divider, wherein said resistive load is coupled across an input and an output terminal of the third amplifier, wherein said first ratio is defined by values of the first resistive load and a second resistive load disposed in the first circuit; wherein the second ratio is defined by values of third and fourth resistors disposed in the resistive voltage divider.

* * * * *